US006477742B2

(12) United States Patent
Pferdmenges et al.

(10) Patent No.: US 6,477,742 B2
(45) Date of Patent: Nov. 12, 2002

(54) DEVICE FOR SEPARATING WASTE FROM FIBER MATERIAL WHILE PROCESSED IN A CARDING MACHINE

(75) Inventors: Gerd Pferdmenges, Jüchen; Robert Pischel, Mönchengladbach, both of (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/045,068

(22) Filed: Jan. 15, 2002

(65) Prior Publication Data

US 2002/0059699 A1 May 23, 2002

Related U.S. Application Data

(63) Continuation of application No. 09/978,785, filed on Oct. 18, 2001.

(30) Foreign Application Priority Data

Oct. 18, 2000 (DE) ..... 100 51 695

(51) Int. Cl.[7] ..... D01G 15/82
(52) U.S. Cl. ..... 19/109; 19/108; 19/102
(58) Field of Search ..... 19/98, 107, 108, 19/109, 102, 110, 111, 218, 115 B

(56) References Cited

U.S. PATENT DOCUMENTS 4,524,492 A 6/1985 Elliott
5,022,121 A * 6/1991 Rutz ..... 19/100
5,075,930 A * 12/1991 Carey et al. ..... 19/102
6,145,166 A * 11/2000 Waeber et al. ..... 19/104

FOREIGN PATENT DOCUMENTS

| | | | |
|---|---|---|---|
| DE | 1 888 942 | 3/1964 | |
| DE | 31 27 418 | 2/1983 | |
| DE | 36 44 529 | 2/1998 | |
| EP | 583219 | * 7/1993 | ..... 19/104 |
| EP | 848091 | * 6/1998 | ..... 19/104 |
| GB | 2245604 | * 1/1992 | ..... 119/104 |
| GB | 2 281 920 | 3/1995 | |
| JP | 4222233 | 8/1992 | |
| NL | 8003654 | 1/1982 | |
| WO | 89/00214 | 1/1989 | |

* cited by examiner

*Primary Examiner*—Danny Worrell
(74) *Attorney, Agent, or Firm*—Venable; Gabor J. Kelemen

(57) ABSTRACT

A carding machine includes a main carding cylinder having a cylindrical surface carrying a cylinder clothing; a cover arrangement extending along a part of the cylindrical surface at a clearance therefrom to define a space between the cylinder clothing and the cover arrangement; a first opening provided in the cover arrangement and communicating with the space between the cylinder clothing and the cover arrangement; and a device for generating a pressurized air stream. The device communicates with the first opening for introducing the pressurized air stream through the first opening into the space between the cylinder clothing and the cover arrangement to impinge upon the cylinder clothing carrying fiber material thereon. A second opening which is provided in the cover arrangement communicates with the space between the cylinder clothing and the cover arrangement for removing the pressurized air stream, laden with waste material separated from the fiber material.

11 Claims, 2 Drawing Sheets

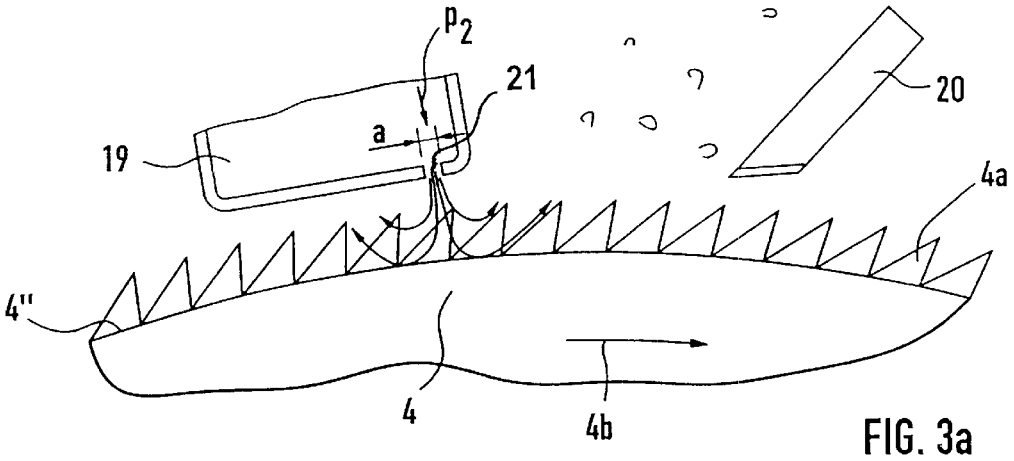
FIG. 3a
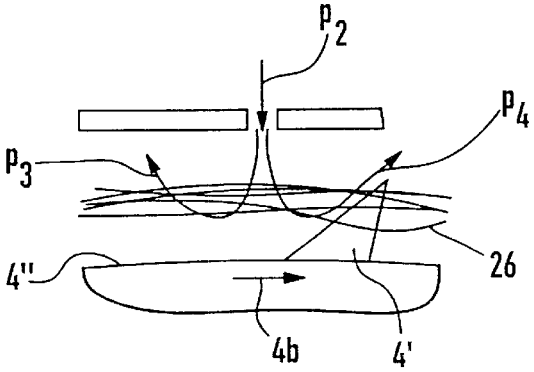
FIG. 3b
FIG. 4
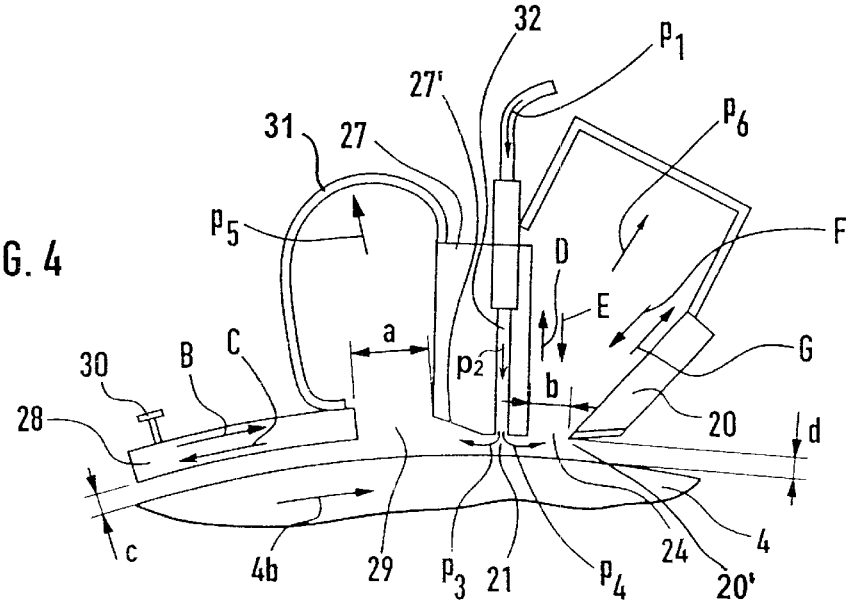

DEVICE FOR SEPARATING WASTE FROM FIBER MATERIAL WHILE PROCESSED IN A CARDING MACHINE

CROSS REFERENCE TO RELATED APPLICATION

This application is a continuation of co-pending application Ser. No. 09/978,785 filed Oct. 18, 2001.

This application claims the priority of German Application No. 100 51 695.5 filed Oct. 18, 2000, which is incorporated herein by reference.

BACKGROUND OF THE INVENTION

This invention relates to a device integrated in a carding machine for processing textile fibers such as cotton fibers and the like. The machine cover facing the clothing of the main carding cylinder has an opening for the admission of air toward the cylinder clothing and further has at least one opening for the exit of air which entrains short fibers, trash and the like away from the cylinder clothing.

The main cylinder of the carding machine has a high circumferential velocity (in excess of 15 m/sec) and entrains a substantial amount of air on its surface. As a result, a vacuum is generated in the circumferential zone of the cylinder, that is, between the machine cover and the cylinder clothing. The fibers are, on the one hand, held by the teeth of the cylinder clothing and are advanced as the cylinder rotates and, on the other hand, are held back by the above-noted vacuum on the cylinder surface. By virtue of the cooperation between the carding cylinder and further carding elements, the fiber material is opened to obtain individual fibers.

In a conventional device as disclosed in European Patent No. 0 338 802 to which corresponds U.S. Pat. No. 5,075,930, there are provided, as viewed in the direction of rotation of the cylinder, first, second, third and fourth covers. The second cover is constituted by a clothed carding element situated radially closer to the cylinder clothing than the first cover. The third cover, as viewed in the circumferential direction of the cylinder, is separated from the second cover by a first gap and is disposed at a greater radial distance from the cylinder clothing than the second cover. The fourth cover, as viewed in the circumferential direction, is separated from the third cover by a second gap. The fourth cover has a separating edge which is shaped in such a manner that it deflects one part of the air stream from the cylinder clothing. Such air stream flows underneath the third cover during rotation of the carding cylinder. The narrow setting of the second cover forms an air barrier by means of which a pressure drop is generated immediately downstream of the second cover, that is, in the region of the first gap. Such a pressure drop is increased by the third cover which is situated at a greater distance from the cylinder surface than the second cover. As a result, the air current flows at an increased speed through the first gap. A screening device, positioned over the first gap, is so shaped that air in the first gap is drawn in only from the side of the carding machine. In such an arrangement the supply air is necessarily drawn in. The rotational air stream entrained by the cylinder is braked to a significant extent by the narrow setting of the second cover. The supply stream which enters only by suction is too weak to effectively detach short fibers, trash and the like from the long fibers and to remove such waste from the fiber mass. It is a further disadvantage that the air drawn in from the machine hall contains dust and the like which is introduced into the fiber material.

SUMMARY OF THE INVENTION

It is an object of the invention to provide an improved device of the above-outlined type from which the discussed disadvantages of the prior art are eliminated and which, in particular, in a simple manner ensures a better detachment and removal of short fibers, trash and the like from the fiber material and reliably prevents an introduction of dust and the like into the fiber material.

These objects and others to become apparent as the specification progresses, are accomplished by the invention, according to which, briefly stated, the carding machine includes a main carding cylinder having a cylindrical surface carrying a cylinder clothing; a cover arrangement extending along a part of the cylindrical surface at a clearance therefrom to define a space between the cylinder clothing and the cover arrangement; a first opening provided in the cover arrangement and communicating with the space between the cylinder clothing and the cover arrangement; and a device for generating a pressurized air stream. The device communicates with the first opening for introducing the pressurized air stream through the first opening into the space between the cylinder clothing and the cover arrangement to impinge upon the cylinder clothing carrying fiber material thereon. A second opening which is provided in the cover arrangement communicates with the space between the cylinder clothing and the cover arrangement for removing the pressurized air stream, laden with waste material separated from the fiber material.

A separation and removal of short fibers, trash and the like from the fiber material carried by the carding cylinder may be performed in a simple manner with the measures according to the invention. The pressurized air stream impinges on the cylinder surface from which the stream rebounds and carries impurities away from the cylinder. The strength of the pressurized air stream may be adjusted so that the separation and removal may be optimized. It is a further advantage of the invention that the introduced pressurized air stream contains no interfering impurities.

BRIEF DESCRIPTION OF THE DRAWINGS

FIG. 3*a* is a schematic enlarged detail of FIG. 2.

FIG. 3*b* is a schematic enlarged detail of FIG. 3*a*.

FIG. 4 is a schematic side elevational view of another preferred embodiment of the invention.

DESCRIPTION OF THE PREFERRED EMBODIMENTS

Figure 1:
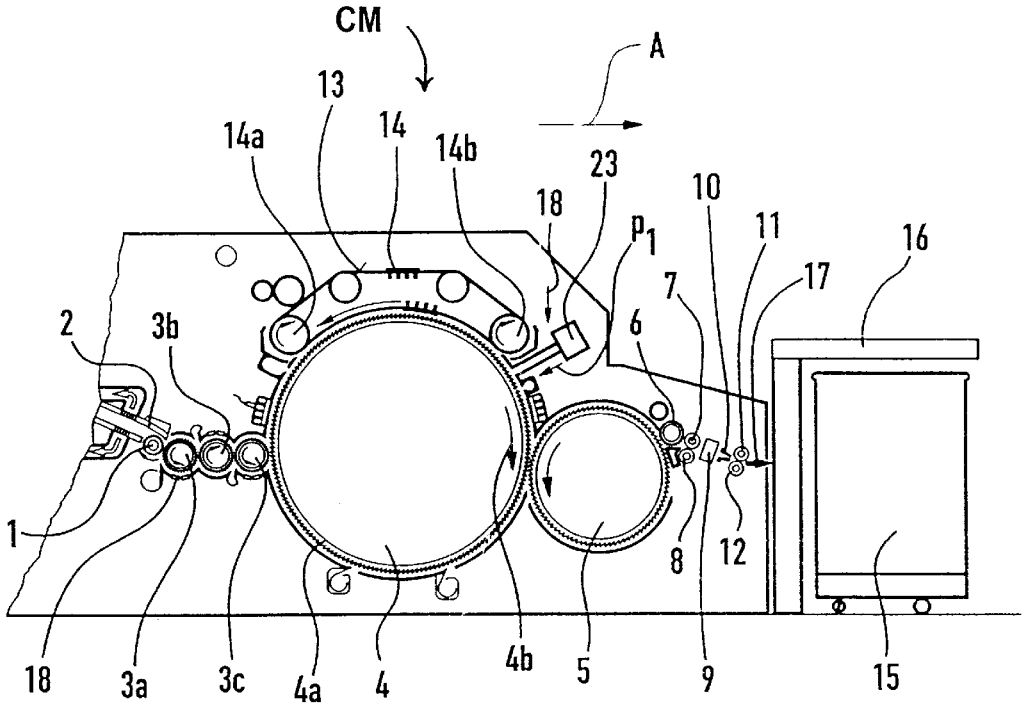
FIG. 1 is a schematic side elevational view of a carding machine incorporating the invention.

FIG. 1 shows a carding machine CM which may be, for example, a high-performance, DK 903 model carding machine manufactured by Trutzschler GmbH & Co. KG, M önchengladbach, Germany. The carding machine CM has a feed roll 1, a feed table 2 cooperating with the feed roll 1, licker-ins 3*a*, 3*b*, 3*c*, a main carding cylinder 4 having a clothing 4*a* and a rotary direction 4*b*, a doffer 5, a stripping roll 6, crushing rolls 7, 8, a web guiding element 9, a web trumpet 10, calender rolls 11, 12 and a traveling flats assembly 13 having slowly circulating flat bars 14. At the outlet of the carding machine a sliver coiling device 16 is provided which deposits the outputted sliver 17 in coils into a coiler can 15. The working direction, that is, the direction of flow of fiber material through the carding machine is designated at A. The device according to the invention is generally designated at 18 and is, in the described example, situated between the doffer 5 and the frontal end roller 14*b* of the flat bar drive belt of the traveling flats assembly 13.

Figure 2:
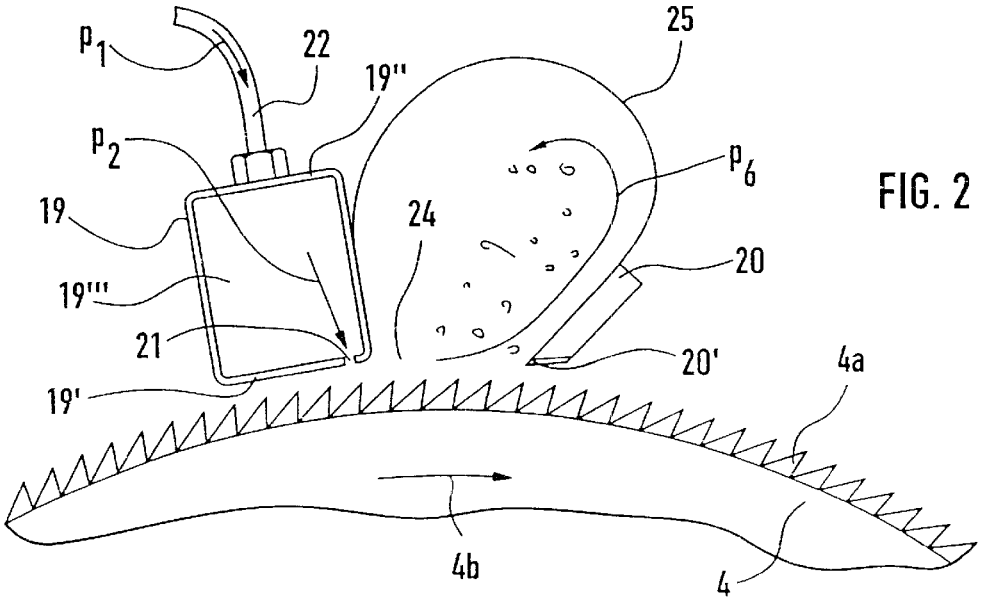
FIG. 2 is an enlarged schematic side elevational detail of FIG. 1, illustrating components of a preferred embodiment of the invention.

Turning to FIG. 2, a pressure chamber 19 and a mote knife 20 provided with a cutting edge 20' are arranged in series as viewed in the rotary direction 4*b* of the carding cylinder 4. The pressure chamber 19 has a lower wall 19' facing, with a clearance, the carding cylinder clothing 4*a*. The lower wall 19' is provided with a through slot 21 extending along the width (axial length) of the carding cylinder 4. A pneumatic conduit 22, connected to a source of pressurized air 23, communicates with the inner space 19''' of the pressure chamber 19 through a non-illustrated opening provided in the upper wall 19'' of the pressure chamber 19. In the region between the pressure chamber 19 and the mote knife 20 a suction hood 25 is disposed which is provided with an opening 24 having a width extending from a lower corner of the suction chamber 19 and the knife edge 20' and a length extending along the width of the carding cylinder 4.

A pressurized air stream $p_1$ flows through the conduit 22 and enters the inner space 19''' of the pressure chamber 19 and forms there a pressurized air stream $p_2$ which leaves the inner space 19''' through the opening 21. The air outlet opening proper may be a nozzle or a plurality of nozzles arranged in a series. A pressurized air stream $p_6$ which carries short fibers, trash, dust and the like, enters through the opening 24 into the suction hood 25 and is removed therefrom by a non-illustrated suction device.

Turning to FIGS. 3*a* and 3*b*, the stream $p_2$ passes substantially vertically through the opening 21 of the pressure chamber 19 and impinges on the cylinder clothing 4*a* which carries the fiber material 26. The stream $p_2$ penetrates the fiber material 26 situated in the gaps between the clothing teeth 4' and impinges on the upper surface 4'' of the cylinder 4, on the wire flank of the spirally wound steel clothing and on the tooth back of the clothing teeth 4'. Upon this occurrence the air stream $p_2$ is divided in such a manner that one partial air stream $p_3$ flows counter the rotary direction 4*b* and another partial air stream $p_4$ flows in the rotary direction 4*b*. The partial stream $p_4$ flows in the rotary direction 4*b*. The partial stream $p_4$ separates short fibers, trash and the like from the long fibers. While the long fibers are entrained by the teeth 4' in the rotary direction 4*b*, the partial air stream $p_4$, carrying the short fibers, trash and the like, enters directly (that is, without being additionally deflected) the suction hood 25 through the opening 24, as apparent when veiwing FIGS. 2, 3*a* and 3*b* together. The partial air streams $p_3$ and $p_4$ are deflected by the upper surface 4'' of the cylinder at an oblique angle.

Thus, the pressure chamber 19 arranged upstream of the opening 24 constitutes a cover element 19 from which, through the slot 21, the air stream $p_2$ is blown onto the cylinder surface 4''. Since the air stream $p_2$ passes through the fiber material 26 and is thrust back by the underlying cylinder surface 4'', short fibers are outwardly transported by the air stream, since they are not as firmly held by the cylinder clothing 4*a* as the long fibers. As a result, the after-connected opening 24 (separating location) may optimally separate the short fibers.

Turning to the embodiment illustrated in FIG. 4, upstream of the mote knife 20 oriented against the rotary direction 4*b* a separating element 27 is arranged in which a port 32 is accommodated for introducing the pressure stream $p_1$. As viewed in the rotary direction 4*b*, a cylinder cover element 28, an opening 29, the separating element 27, the opening 24 and the mote knife 20 are disposed in series. The cylinder cover element 28 is shiftable in the direction of the arrows B and C parallel to the upper cylinder surface for adjusting the width a of the opening 29. The cover element 28 may be immobilized in its set position by a fixing element such as a screw 30 passing through a slot. The foot surface 27' of the separating element 27 facing the points of the clothing 4*a* at a clearance, contains the outlet opening 21 of the port 32 for discharging the air stream $p_2$ which splits into partial streams $p_3$ and $p_4$ in the space between separating member 27 and the cylinder 4. The clearance of the foot surface 27' to the clothing points of the clothing 4*a* is adjustable in the direction of the arrows D and E. The width of the opening 24 is designated at b which extends from the downstream end of the foot surface 27' to the separating knife edge 20'. Above the opening 29 a suction hood 31 is disposed which removes the air stream $p_5$ carrying short fibers, trash and the like. The distance d of the cutting edge 20' from the points of the clothing of the cylinder 4 is adjustable in the direction of the arrows F, G.

The whirling effect of the air stream is further augmented, particularly via the separating location (opening) 24, by a throttle or an accumulating effect in front of the opening 24: the lighter, short fibers are accumulated and stirred in front of the opening 24, while the long fibers are carried through by the cylinder clothing 4*a*.

The device 18 according to the invention may also be positioned between the rearward end roll 14*a* of the flat bar drive belt and the licker-in 3*c*.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder having a direction of rotation and a cylindrical surface carrying a cylinder clothing;

(b) a cover arrangement extending along a part of said cylindrical surface at a clearance therefrom to define a space between said cylinder clothing and said cover arrangement;

(c) a first opening provided in said cover arrangement and communicating with said space;

(d) a device for generating a pressurized air stream; said device communicating with said first opening for introducing the pressurized air stream through said first opening into said space to impinge upon said cylinder clothing carrying fiber material thereon; and (e) a second opening provided in said cover arrangement; said second opening communicating with said space for removing said pressurized air stream, laden with waste material separated from the fiber material, from said space; said second opening being separate from, and immediately adjoining said first opening for directly receiving an air stream reflected from said main carding cylinder.

2. The carding machine as defined in claim 1, wherein said first opening is disposed upstream of said second opening as viewed in said direction of rotation.

3. The carding machine as defined in claim 1, wherein said first opening is disposed downstream of said second opening as viewed in said direction of rotation.

4. The carding machine as defined in claim 1, further comprising a suction hood positioned over said second opening for drawing said pressurized air stream through said second opening by suction.

5. The carding machine as defined in claim 1, further comprising a mote knife bordering said second opening and oriented against the direction of rotation of said carding cylinder.

6. The carding machine as defined in claim 1, further comprising means for adjusting a clearance between said cover arrangement and said cylinder clothing.

7. The carding machine as defined in claim 1, wherein said cylinder has a rotary axis and a length extending parallel to said rotary axis; and further wherein said first opening is slot-shaped and extends throughout said length.

8. The carding machine as defined in claim 1, wherein said first opening is composed of a plurality of nozzles.

9. The carding machine as defined in claim 1, wherein said first opening is oriented such that the air stream discharged thereby into said space is directed perpendicularly to said cylindrical surface deflecting at least one part of the air stream toward said second opening.

10. The carding machine as defined in claim 1, wherein said first opening is composed of a nozzle.

11. The carding machine as defined in claim 1, further comprising means for adjusting a flow passage area of said first opening.

* * * * *